US010966030B2

(12) United States Patent
Jung

(10) Patent No.: US 10,966,030 B2
(45) Date of Patent: *Mar. 30, 2021

(54) MEMS MICROPHONE, METHOD OF MANUFACTURING THE SAME AND MEMS MICROPHONE PACKAGE INCLUDING THE SAME

(71) Applicant: DB HITEK CO., LTD., Seoul (KR)

(72) Inventor: Min Hyun Jung, Chungcheongbuk-do (KR)

(73) Assignee: DB HITEK CO., LTD., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/403,125

(22) Filed: May 3, 2019

(65) Prior Publication Data

US 2019/0342671 A1 Nov. 7, 2019

(30) Foreign Application Priority Data

May 3, 2018 (KR) ..... 10-2018-0051209

(51) Int. Cl.

| | |
|---|---|
| ***H04R 19/04*** | (2006.01) |
| ***H04R 1/04*** | (2006.01) |
| ***H04R 7/04*** | (2006.01) |
| ***H04R 31/00*** | (2006.01) |

(52) U.S. Cl.

CPC ..... *H04R 19/04* (2013.01); *H04R 1/04* (2013.01); *H04R 7/04* (2013.01); *H04R 31/003* (2013.01); *H04R 2201/003* (2013.01)

(58) Field of Classification Search

CPC ..... H04R 1/08; H04R 19/04; H04R 19/005

USPC ..... 381/173, 174, 175, 176

See application file for complete search history.

(56) References Cited

U.S. PATENT DOCUMENTS

| | | | | |
|---|---|---|---|---|
| 9,661,411 | B1 * | 5/2017 | Han | H04R 19/04 |
| 2006/0233401 | A1 * | 10/2006 | Wang | H04R 19/005 381/176 |
| 2009/0185700 | A1 * | 7/2009 | Suzuki | H04R 19/005 381/174 |
| 2010/0212432 | A1 * | 8/2010 | Kasai | H04R 19/005 73/654 |

(Continued)

FOREIGN PATENT DOCUMENTS

KR 101578542 B1 * 12/2015

*Primary Examiner* — Fan S Tsang
*Assistant Examiner* — Julie X Dang
(74) *Attorney, Agent, or Firm* — Patterson Thuente Pedersen, P.A.

(57) ABSTRACT

A MEMS microphone includes a substrate having a cavity defining a vibration area and a peripheral area surrounding the vibration area, a back plate disposed over the substrate and having a plurality of acoustic holes, a diaphragm disposed between the substrate and the back plate to cover the cavity, the diaphragm defining an air gap together with the back plate, and the diaphragm sensing an acoustic pressure to generate a displacement, a plurality of anchors arranged along a circumference of the diaphragm, and spaced apart from each other to define a plurality of slits configured to serve as first vent channels for communicating the air gap with the cavity, and at least one vent hole penetrating through the diaphragm, and serving as a second vent channel for communicating the air gap with the cavity.

12 Claims, 12 Drawing Sheets

(56) References Cited

U.S. PATENT DOCUMENTS

| | | | | |
|---|---|---|---|---|
| 2011/0140215 | A1* | 6/2011 | Sato | G01L 9/0042 257/419 |
| 2012/0213400 | A1* | 8/2012 | Kasai | H04R 19/04 381/369 |
| 2019/0132662 | A1* | 5/2019 | Cheng | H04R 19/005 |

* cited by examiner

MEMS MICROPHONE, METHOD OF MANUFACTURING THE SAME AND MEMS MICROPHONE PACKAGE INCLUDING THE SAME

CROSS-REFERENCE TO RELATED APPLICATION

This application claims priority to Korean Patent Application No. 10-2018-0051209, filed on May 3, 2018, and all the benefits accruing therefrom under 35 U.S.C. § 119, the contents of which are incorporated by reference in their entirety.

TECHNICAL FIELD

The present disclosure relates to a Micro Electro Mechanical Systems (MEMS) microphone capable of converting an acoustic wave into an electrical signal, a method of manufacturing the MEMS microphone, and a MEMS microphone package including the MEMS microphone. More particularly, the present disclosure relates a capacitive MEMS microphone being capable of transforming an acoustic wave into an electric signal using a displacement of a diaphragm which occurs due to an acoustic pressure, a method of manufacturing such a MEMS microphone, and a MEMS microphone package including such MEMS microphone.

BACKGROUND

Generally, a capacitive microphone utilizes a capacitance between a pair of electrodes which are facing each other for detecting an acoustic wave. The capacitive microphone includes a diaphragm and a back plate. The diaphragm may respond to an acoustic pressure to be configured to be bendable. A back plate may face the diaphragm.

The diaphragm may have a membrane structure to perceive an acoustic pressure to generate a displacement. In particular, when the acoustic pressure is applied to the diaphragm, the diaphragm may be bent toward the back plate in response to the acoustic pressure. The displacement of the diaphragm may be perceived through a change of capacitance between the diaphragm and the back plate. As a result, an acoustic wave may be converted into an electrical signal for output.

The capacitive microphone may be manufactured by a semiconductor MEMS process such that the capacitive microphone has a MEMS type having an ultra-small size, which is referred as MEMS microphone. The diaphragm is spaced apart from a substrate including a cavity so that the diaphragm can be freely bent upwardly or downwardly in accordance with the acoustic pressure. The MEMS microphone has an anchor provided at a peripheral portion of the diaphragm. The anchor makes contact with the substrate to stably support the diaphragm from the substrate.

It may be required to control an acoustic resistance of the MEMS microphone to adjust a Signal to Noise Ratio (hereinafter referred to as "SNR") value. Further, the MEMS microphone may be required to make uniform frequency characteristics uniform across a low frequency range and a high frequency range.

SUMMARY

The example embodiments of the present invention provide a MEMS microphone capable of having uniform frequency characteristics as well as increased SNR value.

The example embodiments of the present invention provide a method of manufacturing a MEMS microphone capable of having uniform frequency characteristics as well as increased SNR value.

The example embodiments of the present invention provide a MEMS microphone package including a MEMS microphone capable of having uniform frequency characteristics as well as increased SNR value.

According to an example embodiment of the present invention, a MEMS microphone includes a substrate having a cavity defining a vibration area and a peripheral area surrounding the vibration area, a back plate disposed over the substrate and having a plurality of acoustic holes, a diaphragm disposed between the substrate and the back plate to cover the cavity, the diaphragm defining an air gap together with the back plate, and the diaphragm sensing an acoustic pressure to generate a displacement, a plurality of anchors arranged along a circumference of the diaphragm to connect an end portion of the diaphragm to the substrate, the anchors being spaced apart from each other to define a plurality of slits disposed between adjacent anchors and configured to serve as first vent channels for communicating the air gap with the cavity and at least one vent hole penetrating through the diaphragm, the vent hole serving as a second vent channel for communicating the air gap with the cavity.

In an example embodiment, the slits and the vent hole may be arranged along the same radial line from a center point of the diaphragm.

In an example embodiment, a plurality of vent holes may be arranged along one circle distant from a center point of the diaphragm.

In an example embodiment, a plurality of vent holes may be arranged along an outline defined by the diaphragm.

In an example embodiment, the vent hole may be disposed on one of the slits.

In an example embodiment, the vent hole may make contact with an outline defined by the slits.

In an example embodiment, the diaphragm may include recess portions positioned to correspond to the slits, the recess portions being recessed from a circumference of the diaphragm in a radial direction.

In an example embodiment, the diaphragm may include protrusion portions positioned to correspond to the slits, the protrusion portions being protruded from a circumference of the diaphragm in a radial direction.

According to an example embodiment of the present invention, a MEMS microphone is manufactured as below. After forming an insulation layer on a substrate being divided into a vibration area and a peripheral area surrounding the vibration area, the insulation layer is patterned to form anchor holes for forming an anchor in the peripheral area, the anchor holes being arranged along a circumference of the vibration area. A diaphragm may be formed on the insulation layer, the anchors of connecting the diaphragm to the substrate may be formed, slits may be formed between the anchors adjacent to each other, and at least one vent hole penetrating through the diaphragm may formed. After forming a sacrificial layer on the insulation layer to cover the diaphragm and the anchors, a back plate may be formed on the sacrificial layer to face the diaphragm. After patterning the substrate to form a cavity in the vibration area, a portion of the insulation layer, which is located under the diaphragm, through an etching process using the cavity as a mask may be removed, and then a portion of the sacrificial layer, which corresponds to the diaphragm and the anchor may be removed.

In an example embodiment, the slits and the vent hole may be arranged along the same radial line from a center point of the diaphragm.

In an example embodiment, a plurality of vent holes may be arranged along one circle distant from a center point of the diaphragm.

In an example embodiment, a plurality of vent holes may be arranged along an outline defined by the diaphragm.

In an example embodiment, the vent hole may be disposed on one of the slits.

In an example embodiment, the vent hole may make contact with an outline defined by the slits.

In an example embodiment, the diaphragm may include recess portions positioned to correspond to the slits, the recess portions being recessed from a circumference of the diaphragm in a radial direction.

In an example embodiment, the diaphragm may include protrusion portions positioned to correspond to the slits, the protrusion portions being protruded from a circumference of the diaphragm in a radial direction.

According to an example embodiment of the present invention, a MEMS microphone package includes a substrate having a cavity defined by a first sidewall extending a vertical direction, a back plate disposed over the substrate and having a plurality of acoustic holes, a diaphragm disposed between the substrate and the back plate to cover the cavity, the diaphragm defining an air gap together with the back plate, and the diaphragm sensing an acoustic pressure to generate a displacement, a plurality of anchors arranged a circumference of the diaphragm to connecting an end portion of the diaphragm to the substrate, the anchors being spaced apart from each other to define a plurality of slits being configured to serve as a first vent channel for communicating the air gap with the cavity, at least one vent hole penetrating through the diaphragm, the vent hole further serving as a second vent channel for communicating the air gap with the cavity, and a package portion entirely surrounding the substrate, the back plate, the diaphragm, the anchor and the cavity extending portion, the package portion including a top port which provides a flow path for an acoustic pressure.

In an example embodiment, the slits and the vent hole may be arranged along the same radial line from a center point of the diaphragm.

In an example embodiment, a plurality of vent holes is arranged along one circle distant from a center point of the diaphragm.

In an example embodiment, a plurality of vent holes is arranged along an outline defined by the diaphragm.

According to example embodiments of the present invention as described above, the MEMS microphone includes a plurality of slits serving as the first vent channels and the vent hole serving as the second vent channels. Therefore, the MEMS microphone may have a relatively high acoustic resistance through the slits, and further realizes a high SNR value. Further, the MEMS microphone may have a relatively low sensitivity attenuation property even at a low frequency range. As a result, the MEMS microphone may have a uniform frequency characteristic over a wide frequency range as a whole. As a result, since the MEMS microphone includes both the slits and the vent hole, excellent SNR characteristics and uniform frequency characteristics may be realized at the same time.

The above summary is not intended to describe each illustrated embodiment or every implementation of the subject matter hereof. The figures and the detailed description that follow more particularly exemplify various embodiments.

BRIEF DESCRIPTION OF THE DRAWINGS

Exemplary embodiments can be understood in more detail from the following description taken in conjunction with the accompanying drawings, in which.

Figure 1:
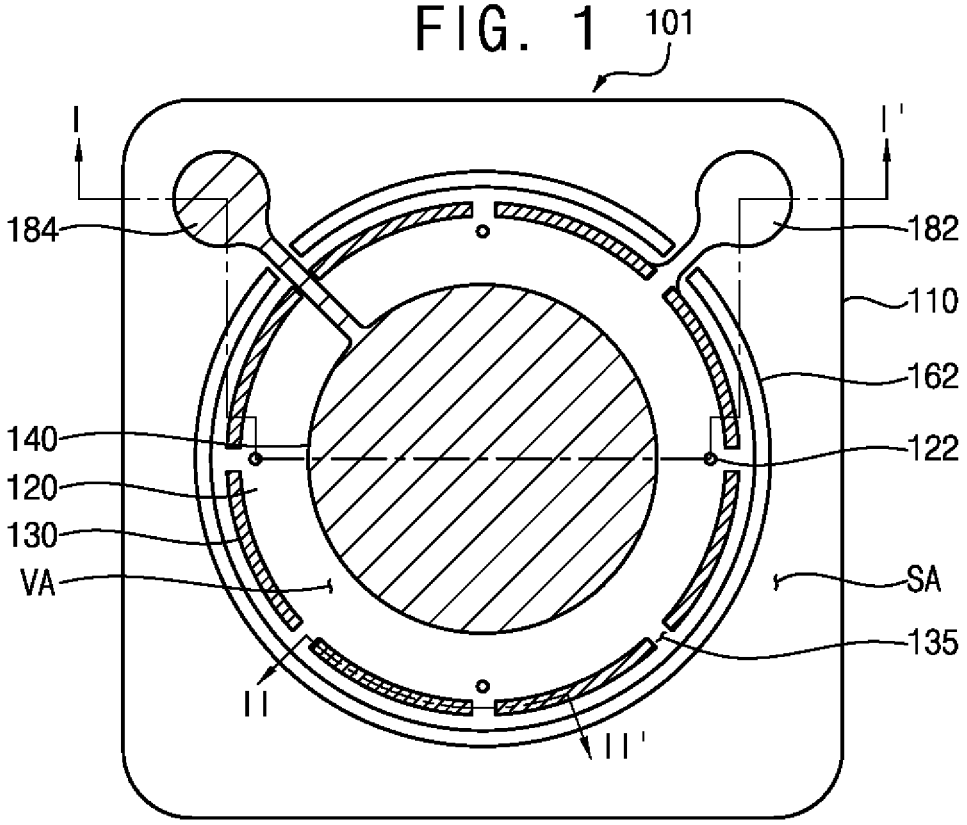
FIG. 1 is a plan view illustrating a MEMS microphone in accordance with an embodiment of the present invention.

While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims.

DETAILED DESCRIPTION OF EMBODIMENTS

Hereinafter, specific embodiments will be described in more detail with reference to the accompanying drawings. The present invention may, however, be embodied in different forms and should not be construed as limited to the embodiments set forth herein.

As an explicit definition used in this application, when a layer, a film, a region or a plate is referred to as being 'on' another one, it can be directly on the other one, or one or more intervening layers, films, regions or plates may also be present. Unlike this, it will also be understood that when a layer, a film, a region or a plate is referred to as being 'directly on' another one, it is directly on the other one, and one or more intervening layers, films, regions or plates do not exist. Also, though terms like a first, a second, and a third are used to describe various components, compositions, regions and layers in various embodiments of the present invention are not limited to these terms.

Furthermore, and solely for convenience of description, elements may be referred to as "above" or "below" one another. It will be understood that such description refers to the orientation shown in the Figure being described, and that in various uses and alternative embodiments these elements could be rotated or transposed in alternative arrangements and configurations.

In the following description, the technical terms are used only for explaining specific embodiments while not limiting the scope of the present invention. Unless otherwise defined herein, all the terms used herein, which include technical or scientific terms, may have the same meaning that is generally understood by those skilled in the art.

The depicted embodiments are described with reference to schematic diagrams of some embodiments of the present invention. Accordingly, changes in the shapes of the diagrams, for example, changes in manufacturing techniques and/or allowable errors, are sufficiently expected. Accordingly, embodiments of the present invention are not described as being limited to specific shapes of areas described with diagrams and include deviations in the shapes and also the areas described with drawings are entirely schematic and their shapes do not represent accurate shapes and also do not limit the scope of the present invention.

Figure 2:
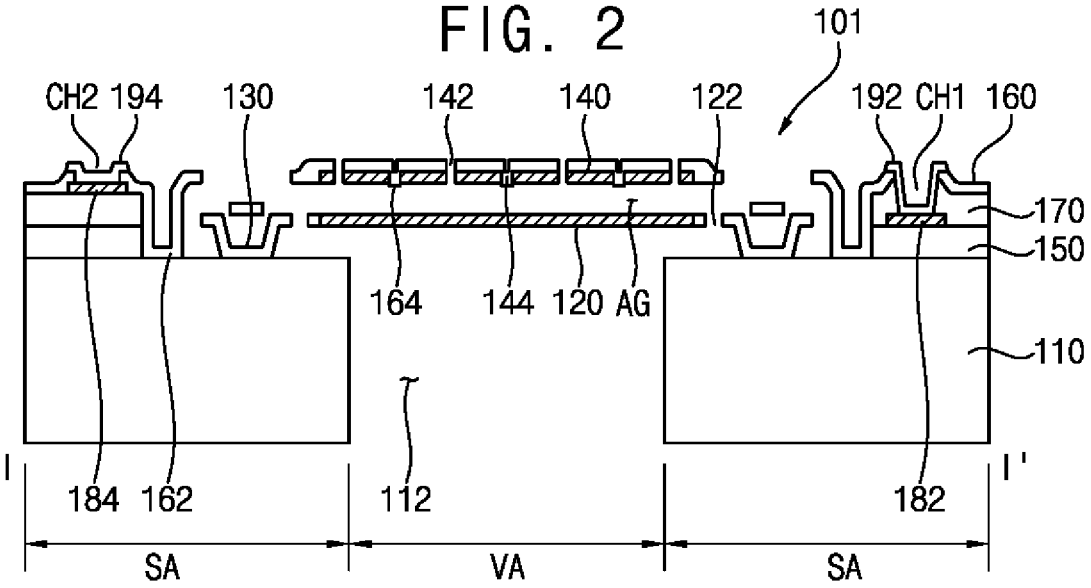
FIG. 2 is a cross sectional view taken along a line I-I' in FIG. 1.
Figure 3:
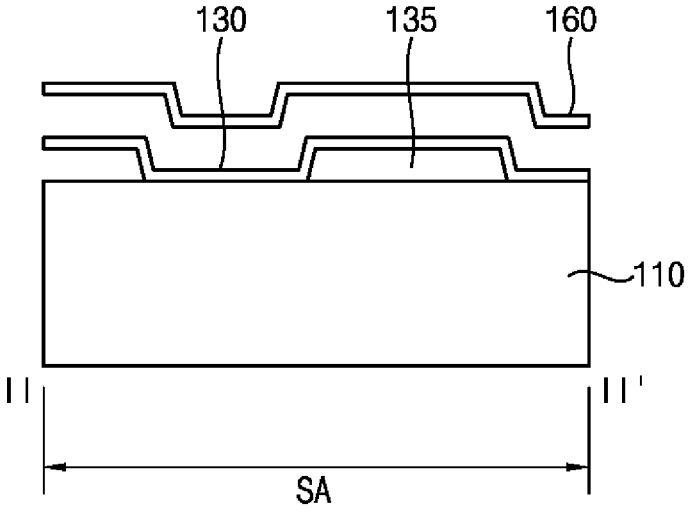
FIG. 3 is a cross sectional view taken along a line II-IF in FIG. 1.

FIG. 1 is a plan view illustrating a MEMS microphone in accordance with an embodiment of the present invention. FIG. 2 is a cross sectional view taken along a line I-I' in FIG. 1. FIG. 3 is a cross sectional view taken along a line II-IF in FIG. 1.

Referring to FIGS. 1 to 3, a MEMS microphone 101 in accordance with an embodiment of the present invention includes a substrate 110, a diaphragm 120, anchors 130, a back plate 140 and at least one vent hole 122. The MEMS microphone 101 is capable of generating a displacement in response to an acoustic pressure to convert an acoustic signal into an electrical signal and output the electrical signal.

The substrate 110 is divided into a vibration area VA and a peripheral area SA. In the vibration area VA, a cavity 112 (FIG. 2) penetrating through the substrate in a vertical direction is formed. Thus, the vibration area VA may correspond to the cavity 112.

The diaphragm 120 may have a membrane structure. The diaphragm 120 may be positioned over the substrate 110 to cover the cavity 112, and the diaphragm 120 may have a lower surface which is exposed to the cavity 112. The diaphragm 120 is spaced apart from the substrate 110 and configured to be bendable in response to an acoustic pressure. The diaphragm 120 and the back plate 140 may define an air gap AG.

The diaphragm 120 may have an ion implantation region into which impurities such III element or V elements are doped. The ion implantation region may correspond to the vibration area VA.

In particular, the diaphragm 120 may have an end portion being connected to the anchors 130.

The anchors 130 are positioned in the peripheral area SA of the substrate 110. The anchors 130 may be arranged along a circumference of the diaphragm 120 and may be spaced apart from each another. Each of the anchors 130 may have a vertical section of a "U" shape as shown in FIGS. 2 and 3.

Accordingly, the MEMS microphone 101 includes the anchors 130 to stably support the diaphragm 120 from the substrate 110.

Further, the MEMS microphone 101 includes a plurality of slits 135 disposed between the anchors 130 adjacent to each other. The slits 135 may serve as first vent channels of communicating the air gap AG with the cavity 112. The slits 135 are provided as paths through which the acoustic wave flows.

The back plate 140 may be positioned over the diaphragm 120. The back plate 140 may be disposed in the vibration area VA. The back plate 140 is spaced apart from the diaphragm 120 and is provided to face the diaphragm 120. Like the diaphragm 120, the back plate 140 may have a disc shape.

The back plate 140 may be spaced apart from the diaphragm 120 to form an air gap AG.

In an example embodiment, the diaphragm 120 may have a plurality of vent holes 122. The vent holes 122 may serves as second vent channels for the acoustic wave to flow between the air gap AG and the cavity 112. Thus, the vent holes 122 may control a pressure balance between the cavity 112 and the air gap AG. Further, the vent holes 122 may prevent the diaphragm 120 from being damaged by acoustic pressure that is applied externally to the diaphragm 120.

The vent holes 122 are positioned along the peripheral area SA. The vent holes 122 may be arranged along the anchor 130 and may be spaced apart from one another, as shown in FIG. 1. The vent holes 122 may penetrate through the diaphragm 120, as shown in FIGS. 1 and 2.

The slits 135 and the vent holes 122 are arranged along the same radial line extended from a center point of the diaphragm 120. Therefore, the first vent channels and the second vent channels are adjacent to one another, such that the acoustic wave may efficiently flow.

Meanwhile, the vent holes 122 are arranged along a circle distant from the center point of the diaphragm 120. Thus, the vent channels are distributed across an entire area of the diaphragm 120 such that the MEMS microphone 101 has relatively a low sensitivity attenuation property.

In an example embodiment, the MEMS microphone 101 includes the slits 135 serving as the first vent channels as well as the vent holes 122 serving as the second vent channels. Thus, the MEMS microphone 101 may realize a relatively high acoustic resistance due to the silts 135 to achieve a relatively high SNR value. Further, since the MEMS microphone 101 further includes the vent holes 122 serving as the second vent channels, the MEMS microphone 101 has a relatively low sensitivity attenuation property while operating at a low frequency range. As a result, the MEMS microphone 101 includes the slits 135 serving as well as the vent holes 122 to make uniform frequency characteristics uniform across a low frequency range to a high frequency range as well as improved SNR characteristics.

In some embodiments, the MEMS microphone 101 may further include a first insulation layer 150, a second insulation layer 160, an insulating interlayer 170, a diaphragm pad 182, a back plate pad 184, a first pad electrode 192 and a second pad electrode 194, as shown in FIG. 2.

In particular, the first insulation layer 150 may be formed on the upper surface of the substrate 110 and may be located in the peripheral area SA.

The second insulation layer 160 may be disposed over the substrate 110. The second insulation layer 160 may also cover a top surface of the back plate 140. The second insulation layer 160 may include an end portion bent from outside of the back plate 140 toward the substrate 110 to form a chamber portion 162 having a section of a "U" shape. The chamber portion 162 may be located in the peripheral area SA.

As shown in FIG. 1, the chamber portion 162 may be spaced apart from the anchors 130 and may have a ring shape so as to surround the anchors 130. The second insulation layer 160 (FIG. 2) is spaced apart from the diaphragm 120 and the anchors 130 to additionally form the air gap AG between the diaphragm 120 and the back plate 140. Therefore, the air gap AG may have an increased volume.

The chamber portion 162 makes contact with the upper surface of the substrate 110 such that the second insulation layer 160 having the chamber portion 162 may support the back plate 140 which is coupled to a lower face of the second insulation layer 160. As a result, the back plate 140 may be kept apart from the diaphragm 120 to maintain the air gap AG.

A plurality of acoustic holes 142 is formed through the back plate 140 and the second insulation layer 160 such that acoustic pressure passes through the acoustic holes 142. The acoustic holes 142 penetrate through the back plate 140 and the second insulation layer 160 and may communicate with the air gap AG.

In an example embodiment, the back plate 140 may have a plurality of dimple holes 144, and the second insulation layer 160 may have a plurality of dimples 164 positioned to correspond to those of the dimple holes 144. The dimple holes 144 penetrate through the back plate 140, and the dimples 164 are provided at positions where the dimple holes 144 are formed.

The dimples 164 may prevent the diaphragm 120 from being coupled to a lower face of the back plate 140. That is, when sound reaches the diaphragm 120, the diaphragm 120 may be bent in a semicircular shape toward the back plate 140, and then can return to its initial position.

According to some example embodiments, the dimples 164 may protrude from the lower face of the back plate 140 toward the diaphragm 120. Even when the diaphragm 164 is severely bent (e.g., so much that the diaphragm 120 contacts the back plate 140), the dimples 164 separate the diaphragm 120 and the back plate 140 from one another so that the diaphragm 120 can return to the initial position rather than becoming stuck in contact with one another more permanently.

The diaphragm pad 182 may be formed on the upper face of the first insulation layer 150. The diaphragm pad 182 may be electrically connected to the diaphragm 120.

The insulating interlayer 170 may be formed on the first insulation layer 150 having the diaphragm pad 182. The insulating interlayer 170 is disposed between the first insulation layer 150 and the second insulation layer 160, and is located in the peripheral area SA. Here, the first insulation layer 150 and the insulating interlayer 170 may be located outside from the chamber portion 162, as shown in FIG. 2.

The back plate pad 184 may be formed on an upper face of the insulating interlayer 170. The back plate pad 184 is electrically connected to the back plate 140 and may be located in the peripheral area SA.

The first and second pad electrodes 192 and 194 may be formed on the second insulation layer 160. The first pad electrode 192 is located in the first contact hole CH1 to make contact with the diaphragm pad 182. On other hands, the second pad electrode 194 is located in the second contact hole CH2 and makes contact with the back plate pad 184. Here, the first and second pad electrodes 192 and 194 may be transparent electrodes.

Figure 4:
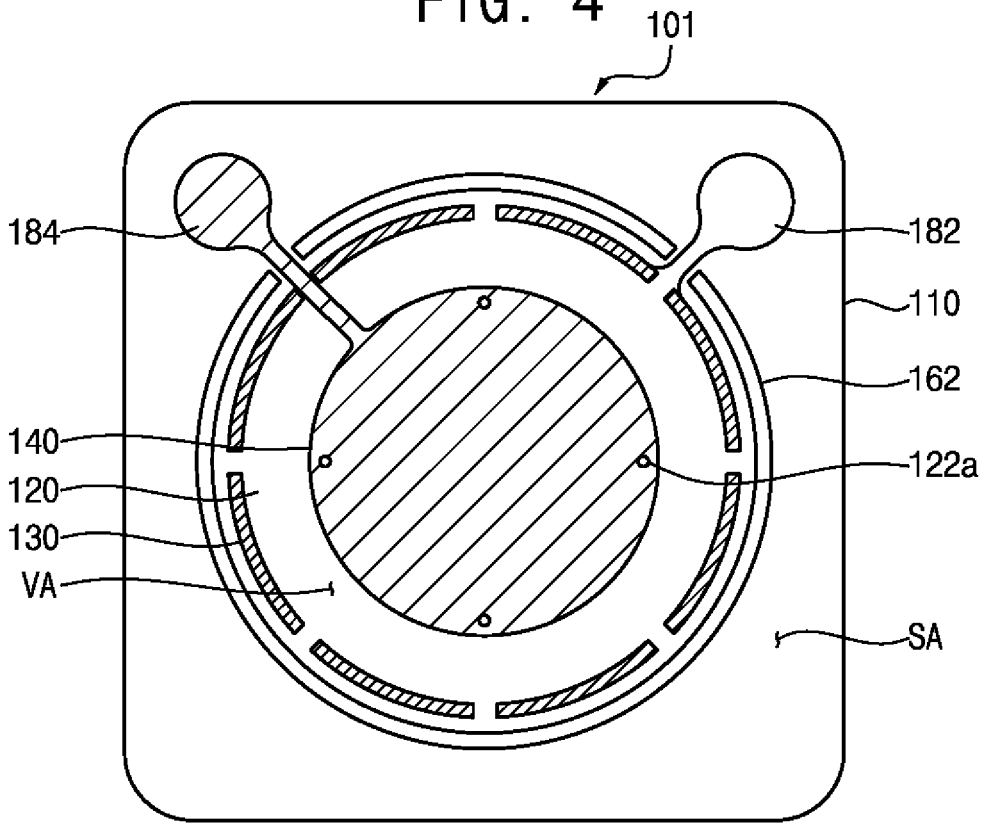
FIGS. 4 and 5 are plan views illustrating a MEMS microphone in accordance with embodiments of the present invention.
Figure 5:
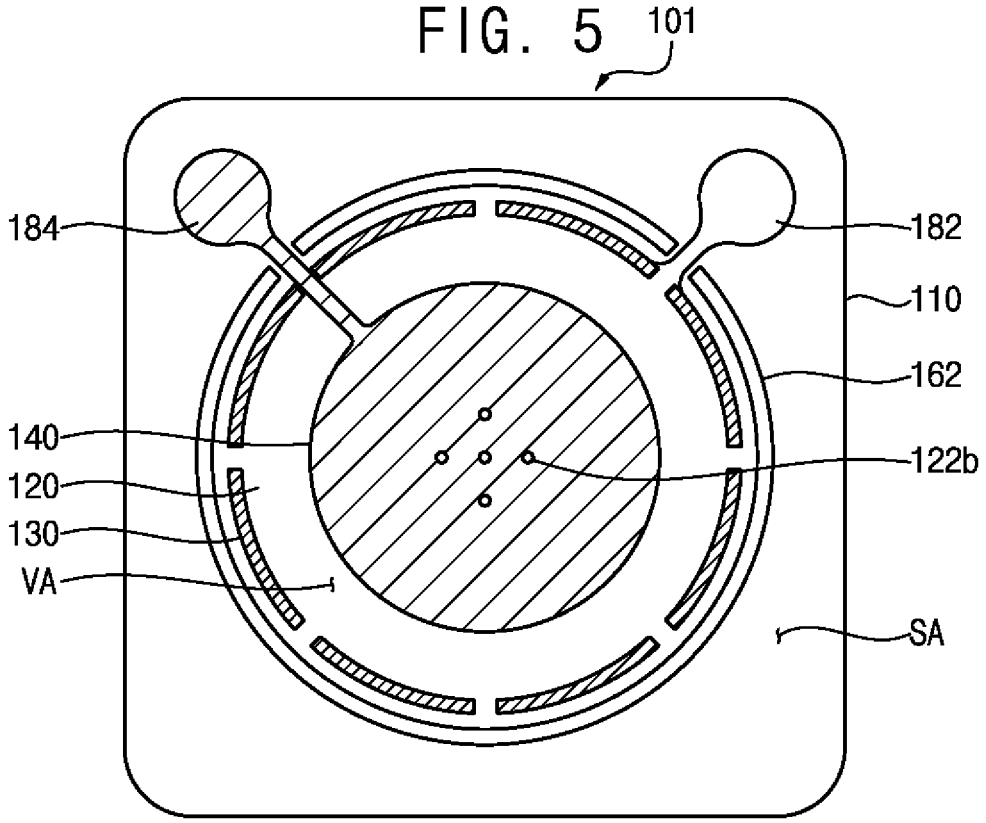

FIGS. 4 and 5 are plan views illustrating a MEMS microphone in accordance with two additional embodiments of the present invention.

Referring to FIG. 4, a MEMS microphone 101 in accordance with example embodiments includes vent holes 122*a*. The vent holes 122*a* may penetrate through the diaphragm 120. The vent holes 122*a* are positioned at a vibration area VA. The vent holes 122*a* may be arranged along a circumference of a back plate 140 in a plan view. Similar reference numbers are used herein to refer to components of the MEMS microphone 101 that are substantially similar to their counterparts in FIGS. 1-3.

Referring to FIG. 5, a MEMS microphone in accordance with another embodiment includes vent holes 122*b*. The vent holes 122*b* may penetrate through the diaphragm 120. The vent holes 122*b* are positioned at a vibration area VA. One of the vent holes 122*b* is positioned at a center point of the diaphragm 120, and the others of the vent holes 122*b* surround the one of the vent holes 122*b*.

Figure 6:
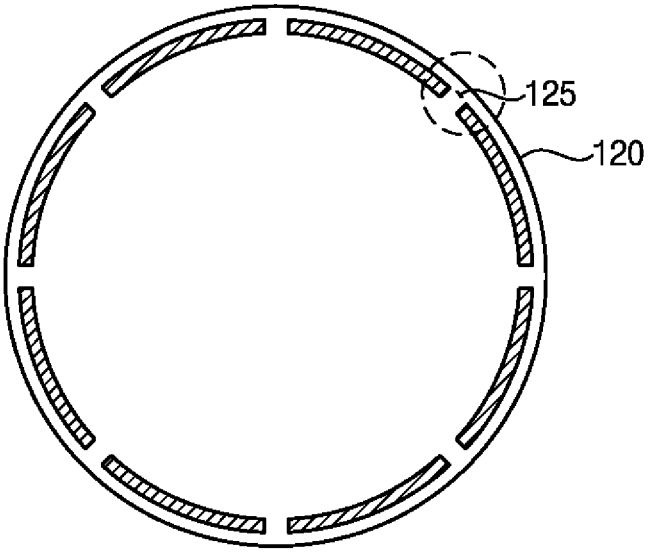
FIG. 6 is a plan view illustrating another example of the diaphragm and the vent holes in FIG. 1.
Figure 7:
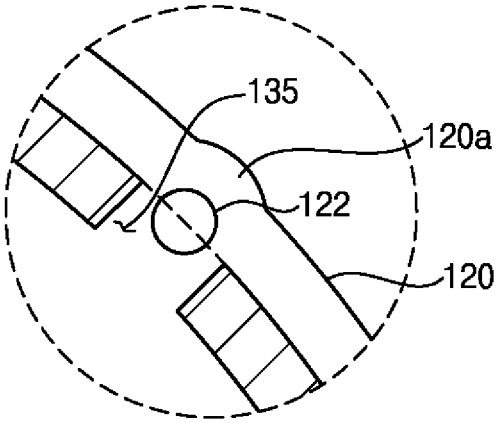
FIGS. 7 and 8 are enlarged plan views illustrating positions of the vent holes in FIG. 6.
Figure 8:
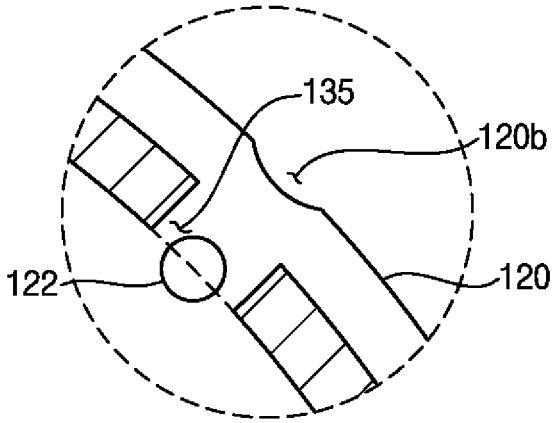

FIG. 6 is a plan view illustrating another example of the diaphragm and the vent holes in FIG. 1. FIGS. 7 and 8 are enlarged plan views illustrating positions of the vent holes in FIG. 6.

Referring to FIGS. 7 and 8, vent holes 122 are positioned at a peripheral area SA. The vent holes 122 may be disposed on one of the slits 135.

Referring to FIG. 7, the vent holes 122 disposed at positioned in contact with an outline defined by the slits 135. The diaphragm 120 may further include at least one protrusion portion 120*a* which protrude from the circumference of the diaphragm 120 in a radial direction. The protrusion portion 120*a* is positioned to correspond to one of the slits 135 to be adjacent to one of the vent holes 122.

Referring to FIG. 8, the vent holes 122 are disposed and positioned in contact with an inner line defined by the slits 135. The diaphragm 120 may further include at least one recess portion 120*b* which is recessed from the circumference of the diaphragm 120 in a radial direction. The recess portion 120*b* is positioned to correspond to one of the slits 135 to be adjacent to one of the vent holes 122.

Hereinafter, a method of manufacturing a MEMS microphone will be described in detail with reference to the drawings.

Figure 9:
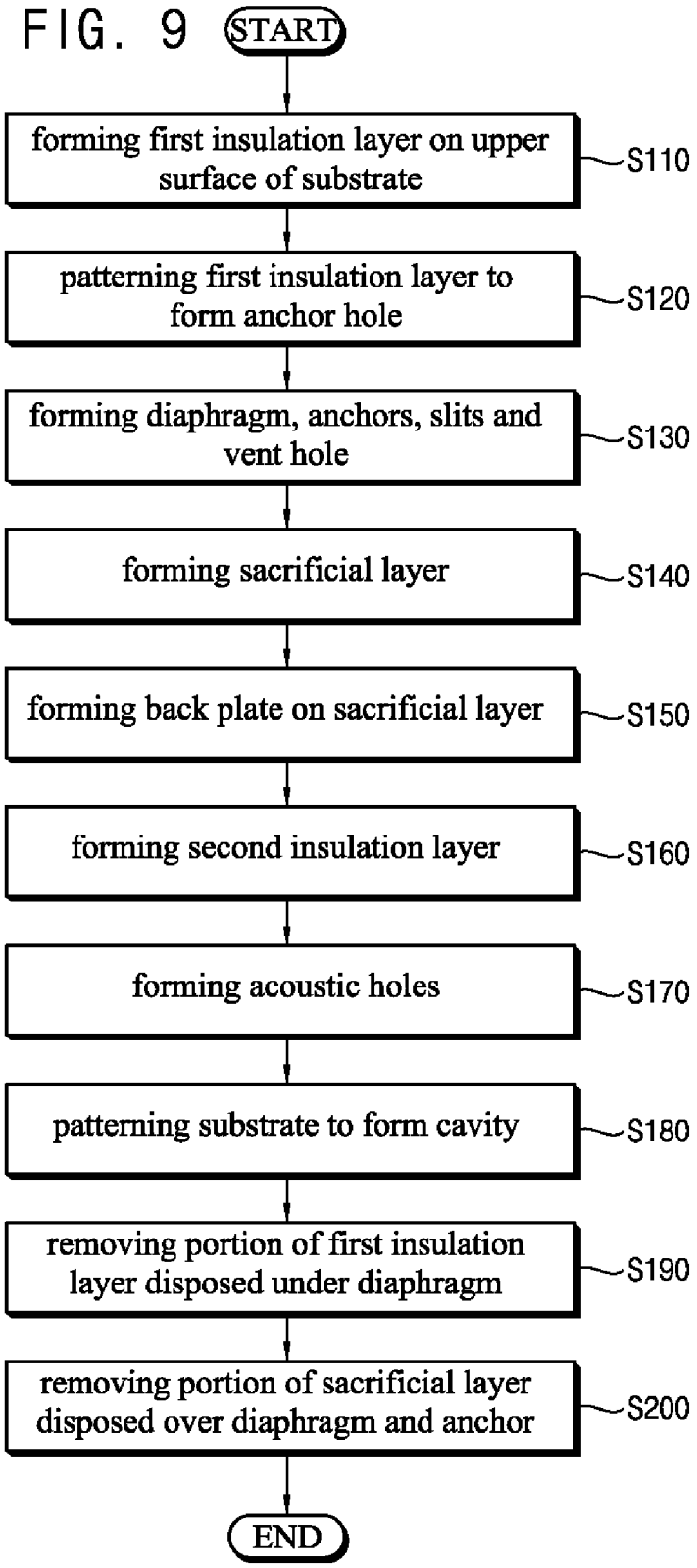
FIG. 9 is a flow chart illustrating a method of manufacturing a MEMS microphone in accordance with an embodiment of the present invention.

FIG. 9 is a flow chart illustrating a method of manufacturing a MEMS microphone in accordance with an example embodiment of the present invention. FIGS. 10 and 12 to 18 are cross sectional views illustrating a method of manufacturing a MEMS microphone in accordance with an example embodiment of the present invention. FIG. 11 is a plan view illustrating the first insulation layer in FIG. 10.

Figure 10:
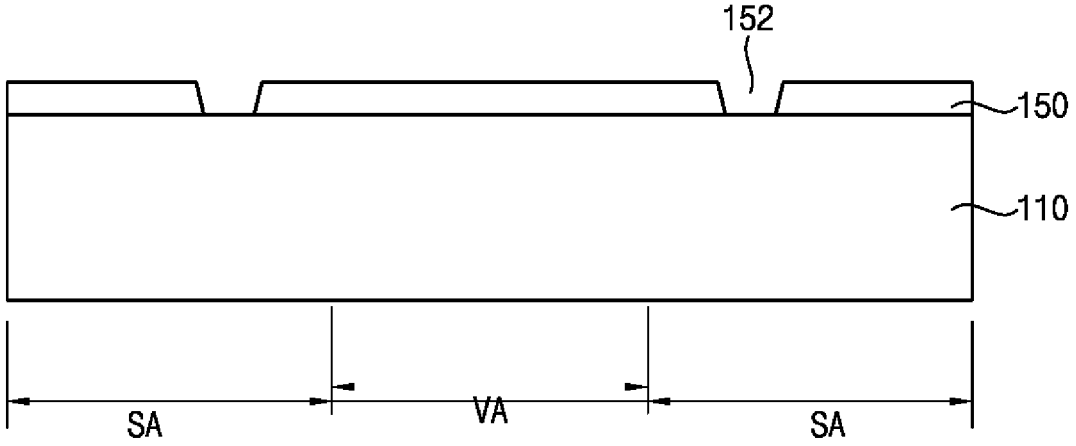
FIGS. 10 and 12 to 18 are cross sectional views illustrating a method of manufacturing a MEMS microphone in accordance with an embodiment of the present invention.
Figure 11:
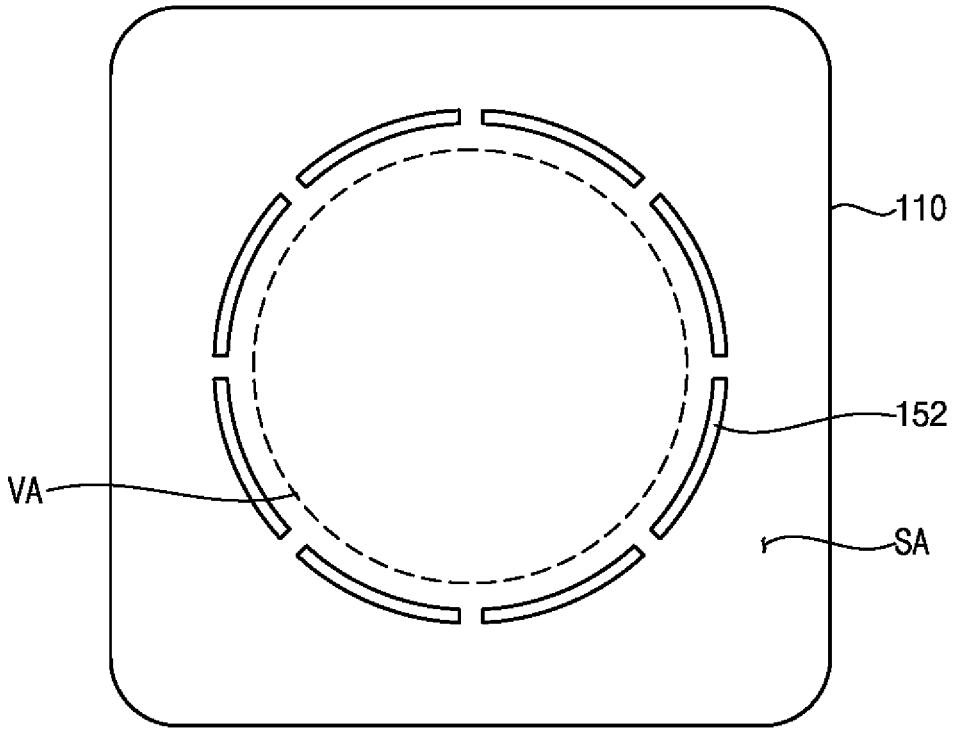
FIG. 11 is a plan view illustrating the first insulation layer in FIG. 10.

Referring to FIGS. 9 to 11, according to an example embodiment of a method for manufacturing a MEMS microphone, a first insulation layer 150 is formed on a substrate 110 (at S110).

Next, the first insulation layer 150 is patterned to form anchor holes 152 for forming anchors 130 (see FIG. 2) (at S120). The anchor holes 152 may be formed in the peripheral area SA and the substrate 110 may be partially exposed through the anchor holes 152. The anchor holes 152 are arranged along a circumference of a vibration area VA. Each of anchors 130 may be formed in the anchor holes 152 to have a vertical section of a "U" shape in a subsequent step.

Figure 12:
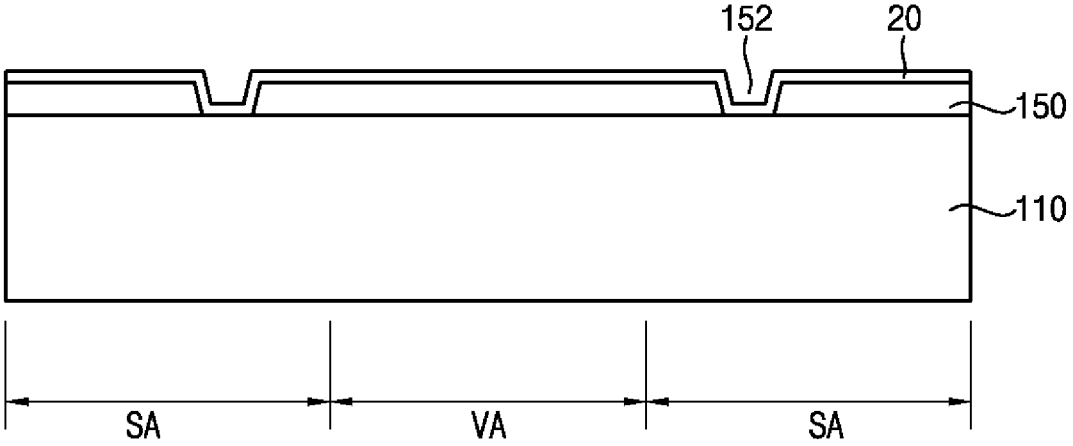

Referring to FIGS. 9 and 12, a first silicon layer 20 is formed on the first insulation layer 150 having the anchor hole 152. The first silicon layer 20 may be formed by a chemical vapor deposition process.

Figure 13:
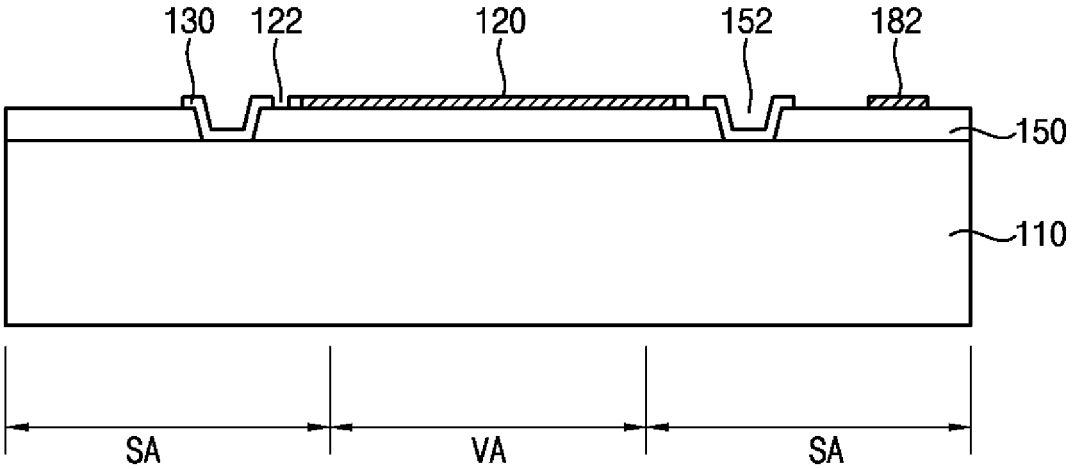

Referring to FIGS. 9 and 13, the first silicon layer 20 is patterned to form a diaphragm 120, the anchors 130, slits 135 (see FIG. 2) and vent holes 122 (at S130). Further, the anchors 130 may be formed in the anchor holes 152 and may make contact with the substrate 110.

Further, a diaphragm pad 182 may be formed on the first insulation layer 150 and in the peripheral area SA. The diaphragm pad 182 is connected to the diaphragm 120.

Figure 14:
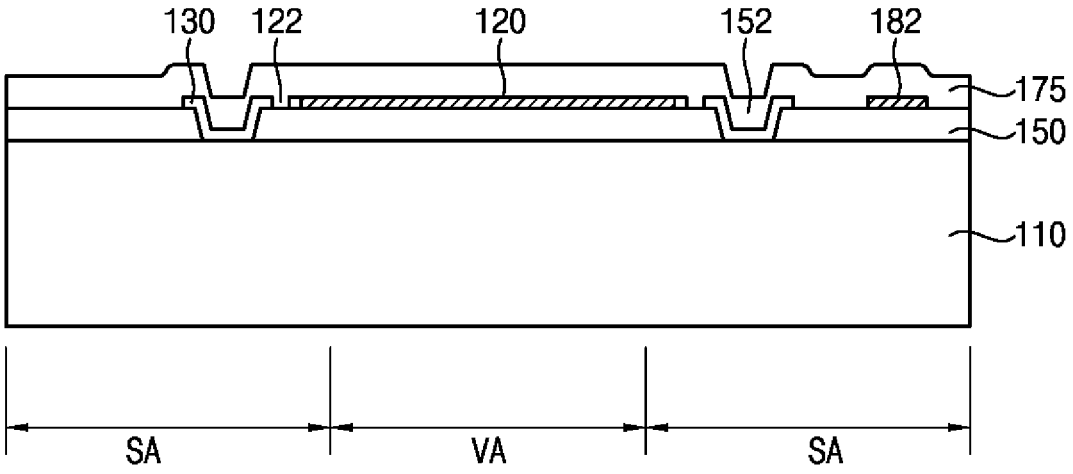

Referring to FIGS. 9 and 14, a sacrificial layer 175 is formed on the first insulation layer 150 to cover the diaphragm 120 and the anchors 130 (at S140).

Figure 15:
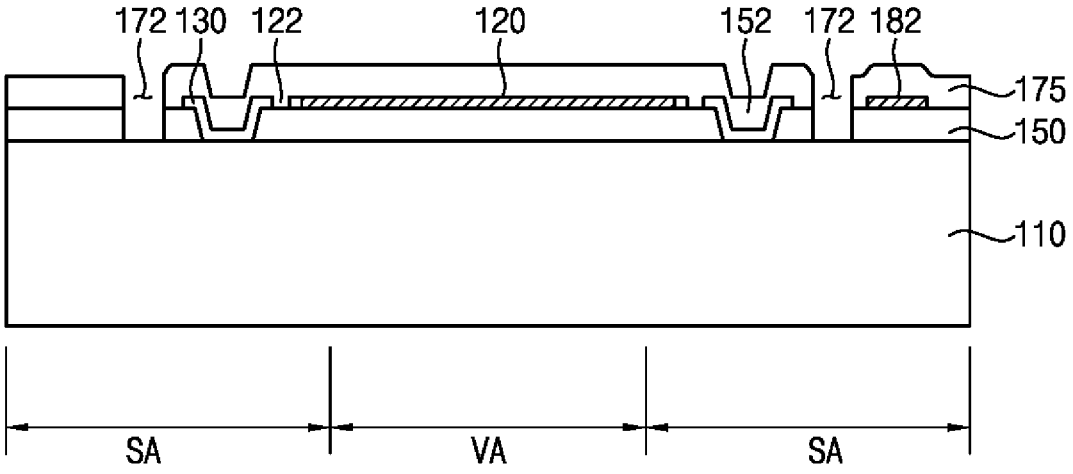

Referring to FIG. 15, the sacrificial layer 175 and the first insulation layer 150 are patterned to form a chamber hole 172. The chamber hole 172 may correspond to an area in which a chamber 162 (see FIG. 2) for fixing a back plate to the substrate 110 is to be formed in a subsequent process of patterning a second insulation layer.

Figure 16:
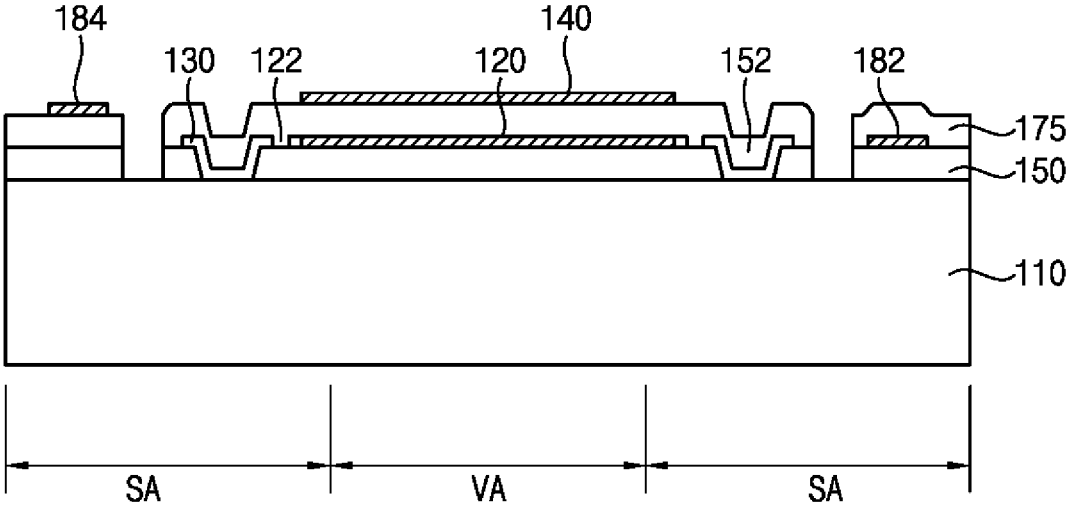

Referring to FIGS. 9 and 16, a second silicon layer (not shown) is formed on the sacrificial layer 175, and then the second silicon layer is patterned to form a back plate 140 in the vibration area VA. At this time, a back plate pad 184 may be formed in the peripheral area SA as well. Further, an ion implantation process may be further performed against the back plate 140

Figure 17:
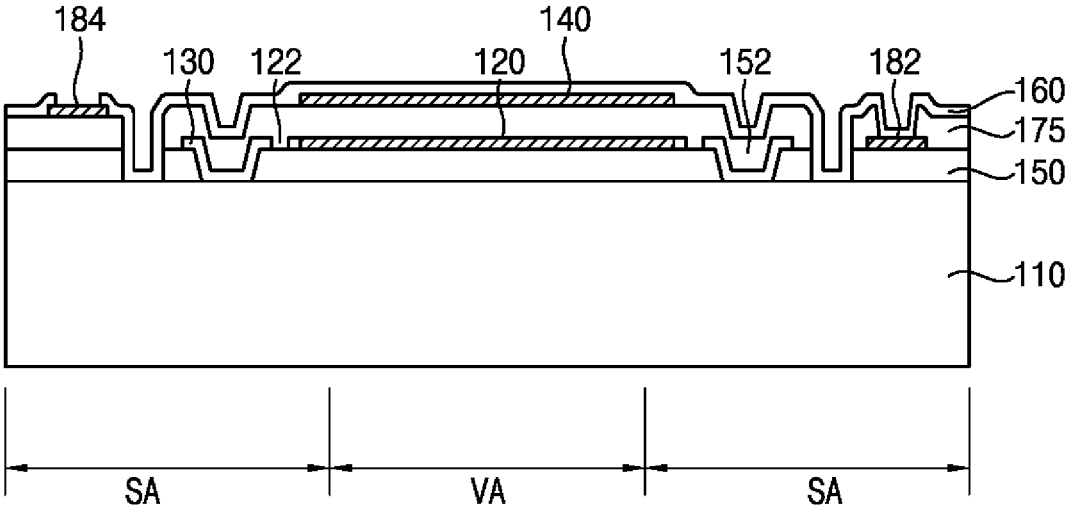

Referring to FIGS. 9 and 17, a second insulation layer 160 is formed on the sacrificial layer to cover the back plate 140 (at S160).

Figure 18:
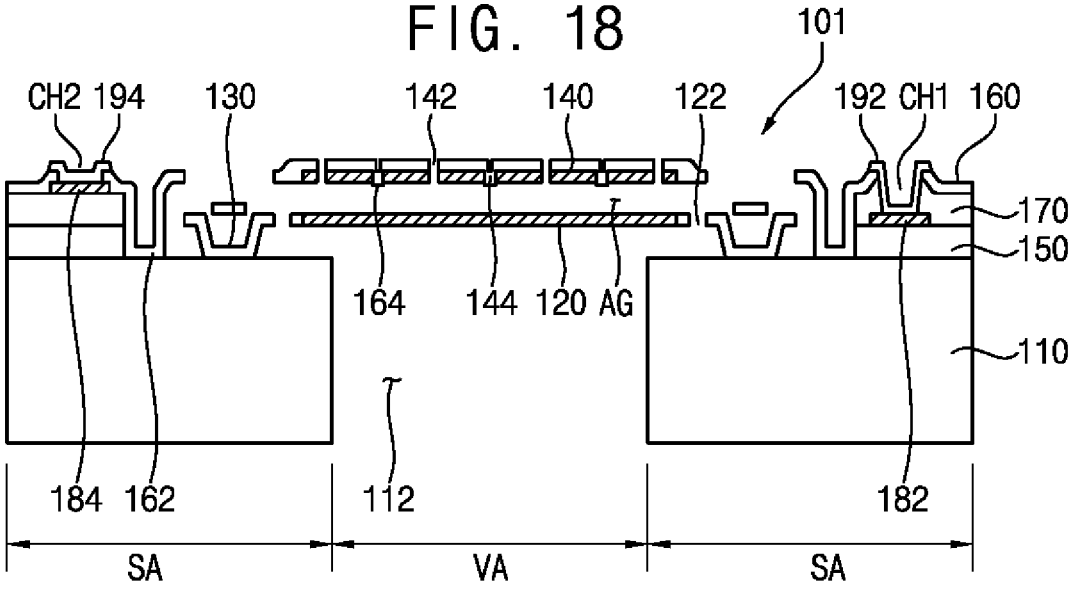

Referring to FIGS. 9 and 18, after forming the second insulation layer (at S160), the second insulation layer 160 may be patterned to form a second contact hole CH2 to expose the back plate pad 184. Further, the second insulation layer 160 and the sacrificial layer 175 are patterned to form a first contact hole CH1 to expose the diaphragm pad 182. Then, a first pad electrode 192 and a second pad electrode 194 are formed in the first and the second contact holes CH1 and CH2, respectively.

Further, the second insulation layer 160 and the back plate 140 are patterned to form acoustic holes 142 (at 170)

Subsequently, the substrate 110 is patterned to form a cavity 112 in the vibration area VA (at S180).

Then, an etchant is supplied to the first insulating layer 150 through the cavity 112 to remove a portion of the first insulating layer 150 located under the diaphragm 120. As a result, the first insulating layer 150 is partially removed, so that only the portion of the second insulating layer 160 located outside the chamber 162 remains on the substrate (at S190).

Subsequently, the air gap AG is formed by removing a portion of the sacrificial layer 175 located on the diaphragm 120 and the anchor 130 (at S200). At this time, the vent holes 122 and the slits 135 of the diaphragm 120 may function as a path through which the etchant flows for removing the portion of the sacrificial layer. When the air gap AG is formed as described above, only the portion of the sacrificial layer 175 existing outside the chamber 162 is left, and the remaining portion is converted into the interlayer insulating film 170. Thus, the MEMS microphone 101, shown in FIGS. 1 and 2, may be manufactured.

Figure 19:
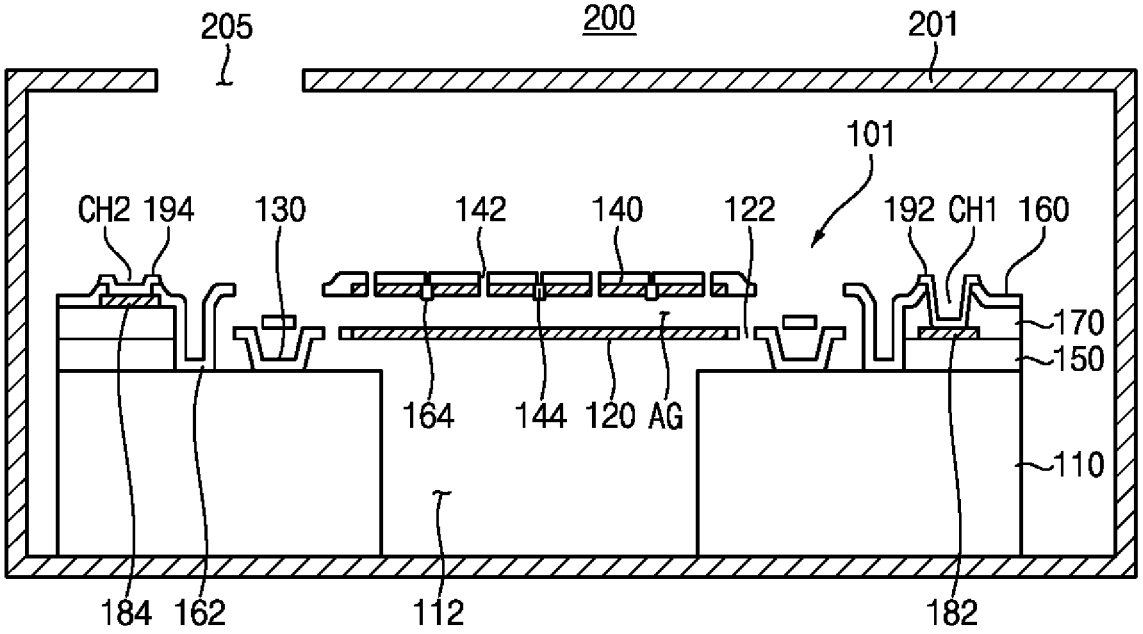
FIG. 19 is a cross sectional view illustrating a MEMS microphone package in accordance with an embodiment of the present invention.

FIG. 19 is a cross sectional view illustrating a MEMS microphone package in accordance with an example embodiment of the present invention.

Referring to FIG. 19, a MEMS microphone package 200 according to an embodiment of the present invention includes a substrate 110, a diaphragm 120, anchors 130, a back plate 140, at least one vent hole 122 and a package portion 201 as well. The package portion 201 surrounds the MEMS microphone 101 including the substrate 110, the diaphragm 120, the anchors 130, the back plate 140 and the vent hole 122. The package portion 201 has a top port 205 through which an acoustic pressure may flow.

That is, the acoustic pressure may be introduced through the top port 205 and applied to acoustic holes 142, an air gap AG, vent holes 122 and cavity 122.

Although the MEMS microphone, the method of manufacturing the MEMS microphone and the MEMS microphone package have been described with reference to the specific embodiments, they are not limited thereto. Therefore, it will be readily understood by those skilled in the art that various modifications and changes can be made thereto without departing from the spirit and scope of the appended claims.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112(f) are not to be invoked unless the specific terms "means for" or "step for" are recited in a claim.

The invention claimed is:

1. A MEMS microphone comprising:

a substrate including:

a vibration area defining a cavity, and a peripheral area surrounding the vibration area;

a back plate disposed over the substrate and defining a plurality of acoustic holes;

a diaphragm disposed between the substrate and the back plate to cover the cavity, the diaphragm defining an air gap together with the back plate, and the diaphragm configured to sense an acoustic pressure to generate a corresponding displacement;

a plurality of anchors arranged along a circumference of the diaphragm to entirely surround the circumference of the diaphragm and to connect an end portion of the diaphragm to the substrate, the anchors being spaced apart from each other to define a plurality of slits disposed therebetween, wherein the slits are configured to serve as first vent channels for fluidically connecting the air gap with the cavity; and at least one vent hole penetrating through the diaphragm, the vent hole serving as a second vent channel for fluidically connecting the air gap with the cavity.

2. The MEMS microphone of claim 1, wherein the slits and the at least one vent hole are arranged along the same radial line from a center point of the diaphragm.

3. The MEMS microphone of claim 1, wherein a plurality of vent holes is arranged along one circle distant from a center point of the diaphragm.

4. The MEMS microphone of claim 1, wherein the MEMS microphone comprises a plurality of vent holes that includes the at least one vent hole arranged along an outline defined by the diaphragm.

5. The MEMS microphone of claim 1, wherein the at least one vent hole is disposed on one of the slits.

6. The MEMS microphone of claim 1, wherein the at least one vent hole is arranged in contact with an outline defined by the slits.

7. The MEMS microphone of claim 1, wherein the diaphragm includes recess portions positioned to correspond to the slits, the recess portions being recessed from a circumference of the diaphragm in a radial direction.

8. The MEMS microphone of claim 1, wherein the diaphragm includes protrusion portions positioned to correspond to the slits, the protrusion portions protruding from a circumference of the diaphragm in a radial direction.

9. A MEMS microphone package comprising:

a substrate having a cavity defined by a first sidewall extending a vertical direction;

a back plate disposed over the substrate and defining a plurality of acoustic holes;

a diaphragm disposed between the substrate and the back plate to cover the cavity, the diaphragm defining an air gap together with the back plate, and the diaphragm configured to detect an acoustic pressure to generate a corresponding displacement;

a plurality of anchors arranged a circumference of the diaphragm to entirely surround the circumference of the diaphragm and to connect an end portion of the diaphragm to the substrate, the plurality of anchors being spaced apart from each other to define a plurality of slits each configured to serve as a first vent channel for fluidically connecting the air gap with the cavity;

at least one vent hole penetrating through the diaphragm, the vent hole further serving as a second vent channel for communicating the air gap with the cavity; and a package portion entirely surrounding the substrate, the back plate, the diaphragm, and the anchor, the package portion defining a top port which provides a flow path configured for transmitting an acoustic pressure.

10. The MEMS microphone package of claim 9, wherein the slits and the at least one vent hole are arranged along the same radial line from a center point of the diaphragm.

11. The MEMS microphone package of claim 9, wherein the MEMS microphone comprises a plurality of vent holes that includes the at least one vent hole arranged along one circle distant from a center point of the diaphragm.

12. The MEMS microphone package of claim 11, wherein the plurality of vent holes is arranged along an outline defined by the diaphragm.

* * * * *